US010689796B2

(12) United States Patent
Lebrun

(10) Patent No.: US 10,689,796 B2
(45) **Date of Patent: *Jun. 23, 2020**

(54) INFINITY SHAPE COIL FOR SPIRAL SEAMS

(71) Applicant: Albany International Corp., Rochester, NH (US)

(72) Inventor: Joseph Louis Lebrun, Rochester, NH (US)

(73) Assignee: Albany International Corp., Rochester, NH (US)

( * ) Notice: Subject to any disclaimer, the term of this patent is extended or adjusted under 35 U.S.C. 154(b) by 226 days.

This patent is subject to a terminal disclaimer.

(21) Appl. No.: 13/827,307

(22) Filed: Mar. 14, 2013

(65) Prior Publication Data

US 2014/0259578 A1 Sep. 18, 2014

(51) Int. Cl.
*D06H 5/00* (2006.01)
*D21F 1/00* (2006.01)

(52) U.S. Cl.
CPC ..... *D06H 5/003* (2013.01); *D21F 1/0054* (2013.01); *D21F 1/0072* (2013.01)

(58) Field of Classification Search
CPC ..... F16G 3/02; F16G 3/00; F16G 3/04; F16G 3/12; D21F 1/0054; D21F 1/0072; D21F 7/0027; D21F 1/0036; D21F 1/0045; D21F 1/0063; D21F 1/0081; D21F 1/12; D21F 1/16; Y10T 24/164; Y10T 24/1636; Y10T 24/1608; Y10T 24/162
USPC ..... 162/904
See application file for complete search history.

(56) References Cited

U.S. PATENT DOCUMENTS

| | | | | |
|---|---|---|---|---|
| 785,019 A | | 3/1905 | Parker | |
| 1,260,065 A | | 3/1918 | Ryan | |
| 1,427,008 A | | 8/1922 | Matsumoto | |
| 2,840,983 A | | 7/1958 | Kellbach | |
| 3,147,586 A | | 9/1964 | Archer | |
| 3,238,594 A | * | 3/1966 | Schuster | D03D 3/04 28/141 |
| 3,641,831 A | | 2/1972 | Palmaer | |
| 3,646,752 A | | 3/1972 | Kampfer | |
| 4,469,221 A | * | 9/1984 | Albert | B65G 17/40 198/851 |
| 4,476,902 A | | 10/1984 | Westhead | |
| 4,493,391 A | | 1/1985 | Van Patten | |
| 4,539,730 A | | 9/1985 | Romanski | |

(Continued)

FOREIGN PATENT DOCUMENTS

| | | |
|---|---|---|
| CA | 1329502 A | 5/1994 |
| EP | 0 524 478 A | 1/1993 |

(Continued)

OTHER PUBLICATIONS

Machine Translation of JP S48-11793 B1 (Year: 1973).*

(Continued)

*Primary Examiner* — Scott R. Walshon
(74) *Attorney, Agent, or Firm* — McCarter & English, LLP

(57) ABSTRACT

A seam for joining fabric edges in which coils of seam elements shaped as a symbol for infinity or a lemniscate, that is, infinity elements, are joined to the fabric edges and the infinity elements are joined to each other with a pintle. A fabric element may be configured as a continuous loop to form an industrial fabric employing the infinity seam elements.

23 Claims, 9 Drawing Sheets

(56) References Cited

U.S. PATENT DOCUMENTS

| | | | | |
|---|---|---|---|---|
| 4,649,619 | A | 3/1987 | Romanski | |
| 4,678,059 | A | 7/1987 | Bowker | |
| 4,791,708 | A | 12/1988 | Smolens | |
| 4,839,213 | A | 6/1989 | Gauthier | |
| 4,862,926 | A | 9/1989 | Barrette et al. | |
| 4,896,702 | A | 1/1990 | Crook | |
| 5,005,610 | A | 4/1991 | Davenport | |
| 5,049,425 | A | 9/1991 | Essele | |
| 5,334,440 | A * | 8/1994 | Halterbeck | B65G 15/54 139/383 A |
| 5,503,196 | A * | 4/1996 | Josef et al. | 139/383 A |
| 5,514,438 | A * | 5/1996 | Crook, Jr. | 428/57 |
| 5,514,450 | A * | 5/1996 | Sanborn | C09D 10/00 428/201 |
| 5,514,456 | A | 5/1996 | Lefferts | |
| 5,609,076 | A * | 3/1997 | Idland | B67B 7/162 81/3.43 |
| D396,658 | S | 8/1998 | Engel | |
| 5,819,811 | A | 10/1998 | Baker et al. | |
| D400,468 | S | 11/1998 | Norman | |
| 6,213,164 | B1 | 4/2001 | Ostermayer et al. | |
| 6,255,998 | B1 | 7/2001 | Podger | |
| 6,267,068 | B1 * | 7/2001 | Fickers et al. | 112/440 |
| 6,349,749 | B1 | 2/2002 | Quigley | |
| 6,353,976 | B1 | 3/2002 | Sutherland | |
| 6,918,998 | B2 | 7/2005 | Hansen | |
| 7,273,074 | B2 | 9/2007 | Hansen | |
| 7,360,642 | B2 | 4/2008 | Perrin et al. | |
| 7,448,416 | B2 | 11/2008 | Harrison | |
| 7,575,659 | B2 | 8/2009 | Billings | |
| 7,691,238 | B2 | 4/2010 | Billings | |
| 2007/0084243 | A1 | 4/2007 | Moore | |
| 2009/0061151 | A1 | 3/2009 | LaFond et al. | |
| 2011/0146913 | A1 * | 6/2011 | Harwood | D21F 1/0036 156/379.6 |

FOREIGN PATENT DOCUMENTS

| | | | |
|---|---|---|---|
| EP | 0 666 366 | A | 8/1995 |
| EP | 0 674 041 | A | 9/1995 |
| FR | 497451 | | 12/1919 |
| FR | 2352994 | A1 | 12/1977 |
| GB | 1 450 988 | | 9/1976 |
| JP | 48-011793 | B | 4/1973 |
| JP | 2-068389 | A | 3/1990 |
| JP | 2004-115936 | A | 4/2004 |
| RU | 2 408 706 | C2 | 1/2011 |
| RU | 2 516 803 | C2 | 5/2014 |
| TW | I 224638 | B | 12/2004 |
| WO | WO 90/06386 | A | 6/1990 |
| WO | WO 91/12441 | A | 8/1991 |
| WO | WO 03/102299 | A | 12/2003 |
| WO | WO 2007/027915 | A1 | 3/2007 |
| WO | WO 2011/022831 | A | 3/2011 |
| WO | WO 2011127594 | A1 * | 10/2011 ..... D06H 5/002 |

OTHER PUBLICATIONS

International Search Reportand Written Opinion issued by European Patent Office as the International Searching Authority for corresponding application PCT/US2014/023419 dated Jun. 20, 2014.

Zou, Nguyen, *Dictionary of Glass Fiber Reinforced Plastic,* Chemical Industry Press, Dec. 31, 2008, pp. 203-204 with brief English abstract noting entries in relevant section of dictionary.

* cited by examiner

INFINITY SHAPE COIL FOR SPIRAL SEAMS

BACKGROUND

Field of the Invention

The present invention relates to seams and seaming materials used in industrial fabrics. More specifically, the present invention relates to seams and seaming materials to reduce seam wear by reducing seam caliper, particularly for reducing the seam caliper at or below the fabric surface planes at least when the fabric is under tension.

Industrial fabrics means endless structures in the form of a continuous loop, and used generally in the manner of conveyor belts. As used throughout this disclosure, "industrial fabrics" refers to fabrics configured for modern papermaking machines, and engineered fabrics, which may be used in the production of nonwovens. Modern papermaking machines employ endless belts configured for use in the forming, pressing, and drying areas, as well as process belts which may also be used in sections of the modern papermaking processes, such as in the pressing section. Engineered fabrics specifically refers to fabrics used outside of papermaking, including preparation machinery for paper mills (i.e., pulp), or in the production of nonwovens, or fabrics used in the corrugated box board industries, food production facilities, tanneries, and in the building products and textile industries. (See, for example, *Albany International Corp.'s* 2010 *Annual Report and* 10-*K*, Albany International Corp., 216 Airport Drive, Rochester, N.H. 03867, dated May 27, 2010.)

In the formation of industrial fabrics, the base fabric may take a number of different forms. For example, the fabric may be woven endless or flat woven, and subsequently rendered into an endless form with a seam. Industrial fabrics, as endless loops, have a specific length, measured circumferentially therearound, and a specific width, measured transversely thereacross. In many applications, industrial fabrics must maintain a uniform thickness, or caliper, to prevent, for example, premature wear in areas where a localized thickness is greater than in the immediate surrounding area, or marking of a manufactured good carried thereon or contacted thereby.

Industrial fabrics and engineered fabrics, used respectively in modern papermaking machines and in the production of nonwovens, for example, may have a width from about 5 feet to over 33 feet, a length from about 40 feet to over 400 feet, and weigh from approximately 100 pounds to over 3,000 pounds.

Because of their size and weight, and the configuration of the industrial machines on which they are used, in many applications it is often convenient to install industrial fabrics on the appropriate machine as a flat article having lengthwise and widthwise edges, and joining the widthwise edges with a seam, for example, to form a continuous belt. When installed flat and formed into a continuous loop structure on an industrial machine, such industrial fabrics may be known as on-machine-seamable fabrics.

Seams have presented problems in the function and use of on-machine-seamable fabrics in at least in that they may have a thickness, or caliper, that is different from that of the industrial fabric edges the seam is joining. Variations in thickness between the seam and the fabric edges can lead to marking of the product carried on the fabric. Seam failure may also result if the seam area has a greater thickness than the fabric edges as the seam is exposed to machine components and resulting abrasion or friction.

To facilitate seaming, many fabrics for industrial use have seaming loops formed on two opposite edges of the fabric to be joined. For example, seaming loops themselves may be formed from the warp yarns of a flat woven fabric. Seaming loops can be formed by removing weft yarns at the ends of the fabric to free end portions of warp yarns. Loops may also be formed by reintroducing (re-weaving) the free end portions of the warp yarns into the fabric.

A seam is formed by bringing the two ends of the fabric together, by interdigitating and alternating the seaming loops at the two ends of the fabric to align the openings in the loops to form a single passage, and by directing a pin, or pintle, through the passage to lock the two ends of the fabric together.

Alternatively, a seaming spiral may be attached to the seaming loops at each of the two ends of an industrial fabric. An example of this method is shown in U.S. Pat. No. 4,896,702 to Crook in which a multilayer industrial fabric is formed. As shown, a tubular base fabric is formed, flattened to form edges at the lengthwise extremities of the fabric, and cross machine direction yarns in the area of the edges are removed. A spiral coil is attached to the seaming loops of the industrial fabric. Alternately, the seaming spirals may be connected to the seaming loops by at least one connecting yarn. The coils of the spirals at the two ends of the industrial fabric may again then be interdigitated and joined to one another on the machine with a pintle to form a seam usually referred to as a spiral seam.

In other alternative solutions, seam reinforcing rings may be attached to edges of a press fabric to be joined as shown in U.S. Pat. No. 7,273,074 to Hansen. According to embodiments of Hansen, the rings provide reinforcement to the seam by functioning as a back-up to the seaming loops and including CD (cross-machine direction) yarns in the formed seam, thereby increasing the strength of the seam. The rings also provide improved flex resistance to the seam. Hansen suggests a desirable feature of a seam in a press fabric is permeability to water and air that is the same as the rest of the fabric.

In a warp loop seam, the rows of loops are formed of extended edge loops of warp yarns in the fabric structure of the fabric. In a spiral seam, each row of loops is instead formed of a separate, preformed yarn spiral, which is extended along and attached by means of a CD pintle connecting the spiral, intermeshed with the machine direction yarns, such as warp yarns, to the seam edge of the fabric. The coils of the spirals at the two ends of the fabric may again be alternatingly interdigitated and joined to one another on the machine to form a spiral seam.

Alternatively, the spiral can be attached to the industrial fabric by a number of cross-machine direction (CD) yarns being raveled a distance from the widthwise seam edge revealing machine direction (MD) yarn lengths Then MD yarns are rewoven into the fabric, forming loops. The spirals are inserted into the thus formed loop edge portion and connected to the loops by one or more pintles. Then the spirals on each fabric edge are interdigitated and a pintle inserted to form the seam.

Regardless of how the spiral is attached, a spiral seam on an industrial fabric usually comprises two spirals, one along each fabric edge, which, when joining together the fabric edges, are interdigitated and aligned with each other so as to form a single passage configured to accept a pintle, wire or the like, to join the fabric edges.

A seam is a critical part of a seamed fabric, since uniform physical characteristics of the industrial fabric are usually required. If the seam itself is not structurally and functionally nearly identical to the industrial fabric, modification of the seam area may be necessary to obtain characteristics sufficiently similar to the main portion of the industrial fabric for the intended application.

SUMMARY OF THE INVENTION

The present invention provides seam elements and the use of the seam elements to join ends of an industrial fabric in forming a continuous loop. Also provided is an endless structure formed from an industrial fabric and seam elements according to this invention.

According to embodiments of the invention, low profile seam elements are disclosed which can eliminate, or at least substantially reduce, seam wear by reducing the seam thickness, or caliper, to a level which is even with, or even below, the fabric surface plane when the fabric is under tension in use.

As used herein, "low profile" seams, or seam elements, or seaming elements, are seams or components of seams which have a profile, defined by the caliper, or thickness, of the seam or seam elements, which is as thin as, or thinner than, the edges of the fabric the seam is used to join, at least when the seam is under tension substantially transverse to the seam axis, as when the fabric is in use. The profile or thickness is that of the seam or seam element when viewed along the axis of the seam.

According to aspects of this invention, seam elements for use in joining a first end and second end of an industrial fabric are provided. At least one of the elements provides an "infinity coil," so named because an axial view of the coil resembles an infinity symbol, commonly, a figure-eight shaped curve, or, mathematically, a lemniscate. As such, each element has two loops, one to attach the seaming element to the industrial fabric. The second loop of the first seaming element is provided to interdigitate with the second loop of the second seaming element, and accept a pintle, or pin, through a passage formed by the interdigitated loops.

According to embodiments of this invention, a fabric can be woven flat, or configured to be flat after weaving, with opposing parallel edges, and formed into an endless loop by joining opposite edges of the fabric article using seaming elements according to this invention.

When elements are referred to as joined or joining, or forming a joint, either with regard to fabric edges or to another element, the joint formed is generally a pinned connection in which the components of the joint (element and fabric or element and element) are generally free to rotate to a degree about an axis of the joint. Characteristics of elements, or the "infinity coil" joined to a fabric edge or to each other will become apparent in the description that follows.

As used in this application, an infinity coil is a shaped coil of material which can, for example, be a monofilament, twisted multifilament, coated or uncoated, or coated or uncoated metal wire, comprising two loops formed by the material passing alternately over and under a pair of parallel linear coplanar support members and crossing in the space between the support members. The support members may be, for example, a double mandrel or a spiral link-type forming apparatus. The loops may be substantially the same size and shape, although differing sizes and shapes are anticipated for certain applications. In forming an infinity coil, a double mandrel is provided comprising two adjacent support members, generally parallel and coplanar to each other, and spaced apart from each other with a center-to-center spacing proportional to the desired center-to-center distance of the loops of the infinity coil. A material, for example, a polyester monofilament, passes over a first mandrel, passes through the space between the two mandrels, passing below and then around and over the top of the second mandrel, back through the space between the mandrels and under the first mandrel. Thus, in a complete turn, the seaming material used to form an infinity coil traces the basic curved shape of a lemniscate, or figure-eight, or infinity symbol. Subsequent infinity coils turns are formed in the same way, offset axially from the previous infinity coil turn. Coil turns can be added until the desired number of coils is formed or the desired axial length, which may be proportional to the number of coils, results.

Other methods may be used to form the infinity coil as will be apparent from the following disclosure.

Infinity coils may be used to join fabric articles, or to join fabric articles to form industrial fabrics as continuous loops of material. When joined to fabric edges or joined to another infinity coil, the joint formed with the disclosed infinity coils is a pinned connection allowing the elements making up the joint to pivot about an axis of the joint to a degree. Other uses for the infinity coils are disclosed or apparent from the following description.

It is noted that in this disclosure and particularly in the claims, terms such as "comprises," "comprised," "comprising" and the like can have the meaning attributed to it in U.S. patent law; e.g., they can mean "includes," "included," "including" and the like.

An object of the disclosed techniques is the production of a seam for use in forming an industrial fabric in which the seam elements are used to join parallel width-wise edges of a fabric to form an industrial fabric.

For a better understanding of the techniques disclosed herein, its advantages and specific objects obtained by its use, reference is made to the accompanying descriptive matter in which preferred, but non-limiting, embodiments are illustrated.

BRIEF DESCRIPTION OF THE DRAWINGS

The following detailed description, given by way of example and not intended to limit the invention to the disclosed details, is made in conjunction with the accompanying drawings, in which like references denote like or similar elements and parts, and in which.

DETAILED DESCRIPTION

Figure 1:
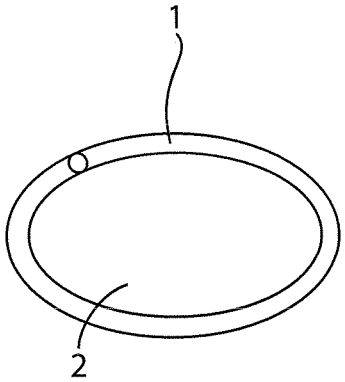
FIG. 1 PRIOR ART
FIG. 1 is an axial view of a conventional coil.

Embodiments of the invention are described below with reference to the accompanying drawings which depict embodiments of the disclosed infinity coil and exemplary applications thereof. However, it is to be understood that application of the disclosed infinity coil is not limited to those embodiments illustrated. Also, the invention is not limited to the depicted embodiments and the details thereof, which are provided for purposes of illustration and not limitation.

The present invention relates to low profile seams in industrial fabrics, and includes engineered fabrics and fabrics used in papermaking, in which wear of the seam is eliminated or at least reduced by reducing the thickness of the seam to no more than the thickness of the fabric joined by the seam, at least when the seam is under tension generally perpendicular to its axis, as when a seamed fabric is in use. That is, when under a tensile load, the seam is as thin as, or thinner than, the fabric joined by the seam.

The present invention relates to seams in fabrics formed into continuous loops for use in industrial applications. Specifically, the present invention relates to seams formed in fabrics installed on an industrial machine, commonly referred to as on-machine-seamable fabrics.

The present invention also relates to a process for producing such an improved seam in an industrial fabric.

"Industrial fabrics," which include paper machine clothing discussed above, means endless structures in the form of a continuous loop, and used generally in the manner of conveyor belts. "Industrial fabrics" as used in this disclosure refers to fabrics configured for modern papermaking machines, and engineered fabrics. Engineered fabrics specifically refers to fabrics used outside of papermaking, including preparation machinery for paper mills (i.e., pulp), or in the production of nonwovens, or fabrics used in the corrugated boxboard industries, food production facilities, tanneries, and in the building products and textile industries.

Seams in on-machine-seamable fabrics have been problematic in that the caliper, or thickness, of the seam region often varies from the caliper of the fabric edges joined by the seam. The problems typically encountered include, but are not limited to, wear of the seam loops or elements and marking of the product carried by the fabric if the seam area is thicker than the fabric edges joined. Wear of the seam material caused by friction or abrasion from contact with machine components can lead to further marking of the product carried by the fabric, and also may lead to catastrophic failure of the fabric. By providing a low profile seam with a seam thickness under tension equal to or less than the thickness of the fabric edges being joined, embodiments of the present invention can eliminate, or at least reduce, frictional and abrasive wear of the seam.

The present invention also relates to the coils used to form seams in industrial fabrics, that is, the invention relates to industrial fabric seaming coils. The coils may be formed from a monofilament or twisted multifilament, coated or uncoated, made from a polymer or polymers, such as polyester, a coated or uncoated metal wire, or from other materials known in the art to be suitable for a seam in an industrial fabric. The coils may be formed as a continuous piece having an appropriate length for the length of the seam to be formed, as measured as the cross machine direction (CD) width of the fabric. In some instances, a coil formed as a continuous piece may have a length the same length as, or nearly the same as, the length of the seam to be formed. Other coil lengths may be useful, such as lengths less then the length of the seam, or greater than the length of the seam and trimmed to an appropriate length. In other embodiments, the coils may be individual pieces of seam material formed into separate seam loops, with a number of individual seam loops arranged along the length of each fabric edge to be joined.

Coils in this application are illustrated as having two enclosed interior portions or nodes, when viewed along the axis of the coil, for ease of illustration. This corresponds with the common infinity symbol or the mathematical lemniscate. However, coils of more than two enclosed interior portions or nodes are anticipated, and are also referred to as infinity coils because they comprise coil turns forming at least one infinity symbol or lemniscate. Such coils lend themselves to similar manufacturing techniques using a forming apparatus with a number of support members corresponding to the number of desired nodes. Infinity coils with more than two nodes have industrial uses, for example, uses similar to those disclosed for the two-node coils.

Other embodiments of the present invention can provide an industrial fabric with uniform physical characteristics throughout the fabric, particularly from edge to edge across the seam region, that is, across the width of the fabric (CD) in the area of the seam, including the seam itself.

Figure 1A:
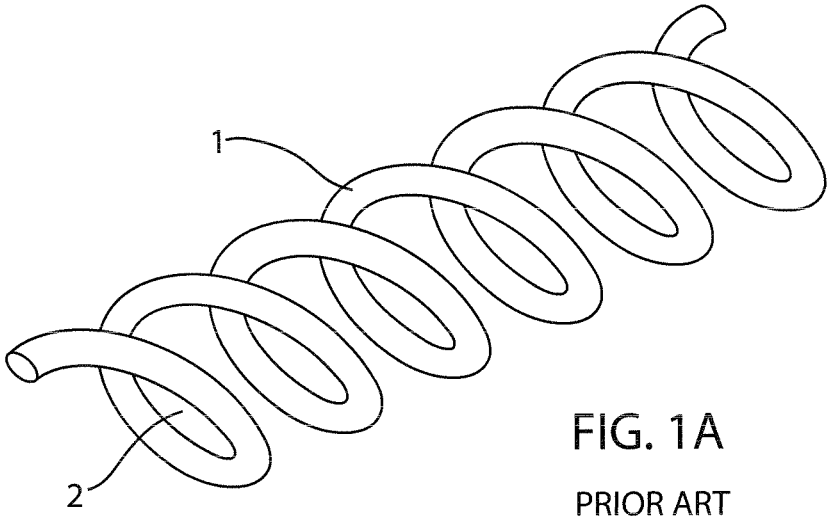
FIG. 1A PRIOR ART
FIG. 1A is a perspective view of the conventional coil of FIG. 1.
Figure 2:
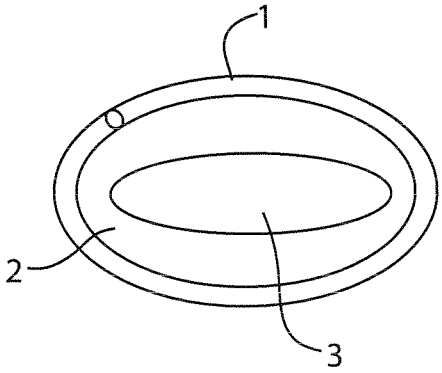
FIG. 2 PRIOR ART
FIG. 2 is an axial view of the coil of FIG. 1 formed on a single mandrel.

A loop 1 for a conventional, prior art spiral coil spiral seam, as shown in an axial view in FIG. 1 and in a perspective view in FIG. 1A, has a curved shape, approximating a circular or ovular shape. Successive coils are similarly shaped and approximately coaxial, extending into the paper as illustrated. Typically, such coils are formed by placing successive coaxial coils of material, for example a polyester monofilament, on a single mandrel 3 as shown in FIG. 2. The open interior portion 2 is similarly shaped and proportional in size to the mandrel 3 upon which it is formed. Although an ovular shaped mandrel is shown, other shapes may be used for the mandrel.

The seaming materials may be a monofilament or a twisted multifilament, coated or uncoated, formed from one or more polymers such as polyester, or metal wire, or other material known in the art. The seaming materials or individual coils may be coated or treated as required by the specific application to have desirable properties. In cross section, the spiral coils may be round, rectangular, oval, flattened, or other noncircular shapes.

Figure 3:
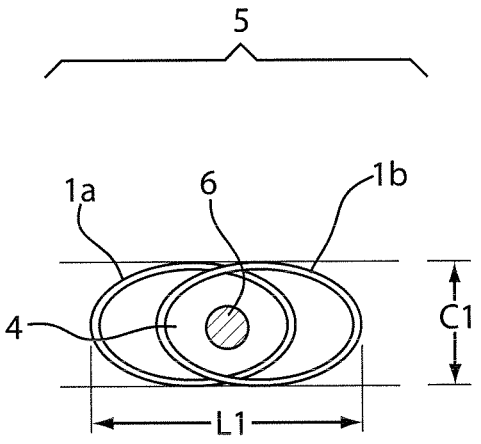
FIG. 3 PRIOR ART
FIG. 3 is an axial view of conventional coil seam.

When two coils 1*a* and 1*b* are joined to opposite fabric edges (not shown) and configured to form a spiral coil seam illustrated generally as 5 in FIG. 3, at least some of the open interior portions 2 of the two spiral coil loops 1 align to form a passage 4 to accept a pintle or pin 6, forming a seam joining the two fabric edges. The two conventional spiral coil loops 1 are generally free to pivot or rotate about the axis of the pintle which substantially corresponds with the axis of the seam 5. Often the spiral coil seam thickness is slightly greater than the joint thickness before tension is applied. The thickness or caliper C1 of the fabric edges joined corresponds with the caliper of the coil loops as shown in FIG. 3.

Figure 4:
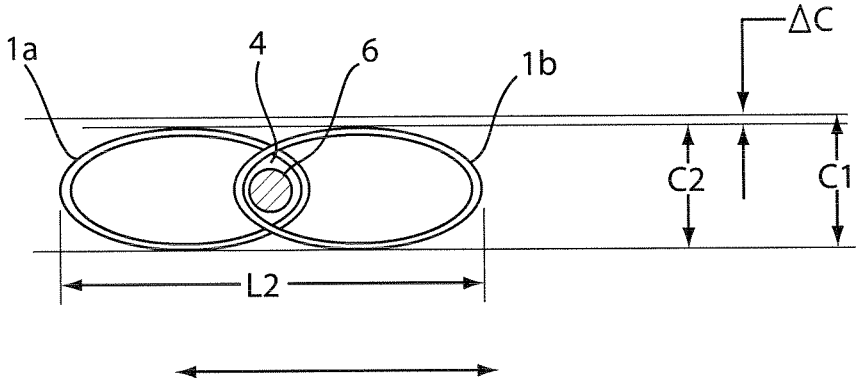
FIG. 4 PRIOR ART
FIG. 4 is an axial view of the conventional coil seam of FIG. 3 under an increased tensile load transverse to the axis of the seam.

When the seam 5 of FIG. 3 is placed in tension perpendicular to the axis of the seam, which corresponds with the axis of the pintle 6, that is tension in the length direction of the industrial fabric, conventional spiral coil loops 1*a* and 1*b* tend to elongate slightly in the direction of the tension indicated by the arrow in FIG. 4, and contract slightly a distance in the direction perpendicular to the tension. That is, in the case of oval coils, the major diameter of the coils lengthens and the minor diameter shortens.

Further, the size of the single passage 4 formed by the aligned interior portions 2 decreases and approaches the size of the pintle 6 as the conventional coils 1 are displaced longitudinally and elongate. The conventional coil loops 1 thus joined remain free to pivot or rotate about the longitudinal axis of the pintle 6.

Accordingly, the initial seam length L1 in FIG. 3 lengthens to L2 of FIG. 4 and the thickness of the seam changes by a small amount ΔC which is equivalent to the difference C1−C2. When C1 is greater than C2, the seam 5 is sometimes referred to as experiencing "seam thinning," as the seam decreases slightly in thickness from a first tensile state to a second tensile state. Conventional spiral coils are purposely designed to have minimal elongation. The spiral coils are usually quite stiff. Thus, the degree of "seam thinning" as defined here is small. As drawn in FIG. 4, the total amount of the seam thinning is shown as ΔC on one side of the seam 5 only for ease of illustration. In practice, approximately even amounts of seam thinning would be present on each side of the thickness of seam 5.

Figure 5:
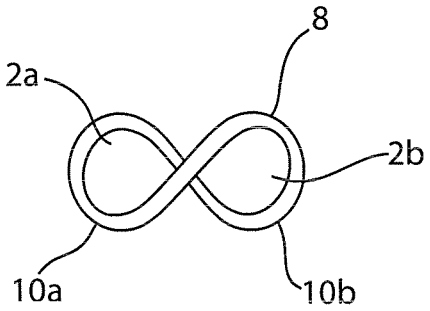
FIG. 5 is an axial view of an infinity coil according to embodiments of this invention.
Figure 5A:
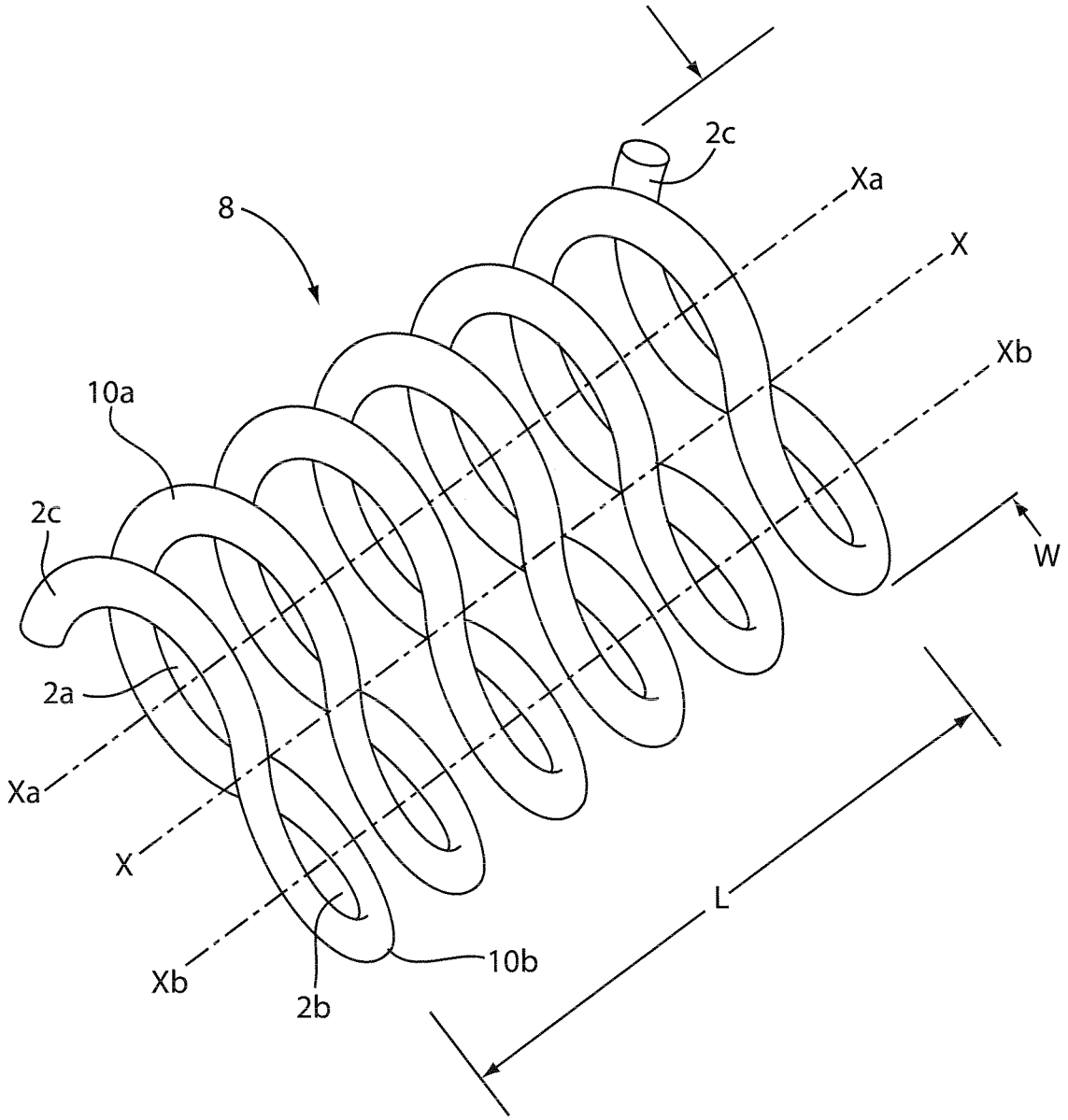
FIG. 5A is a perspective view of the infinity coil of FIG. 5.

According to embodiments of the present invention, a low profile seam element is provided in the form of the infinity coil 8 in FIGS. 5 and 5A, formed as a figure-eight shaped curve, or a lemniscate, resembling a symbol commonly used to represent infinity, ∞. According to embodiments of the invention, a continuous helical infinity coil as illustrated in FIGS. 5 and 5A is an infinity coil formed from a continuous strand of material. When viewed parallel to the axis X-X of the coil, the continuous helical infinity coil will appear to have two closed curves forming first and second infinity coil loops 10*a* and 10*b*, respectively, with first and second open interior portions 2*a* and 2*b*, respectively. Coils according to embodiments of the invention may also have more than two open interior portions, yet are still referred to as infinity coils throughout the disclosure. For example, a seaming material can be formed as three or more closed curves forming three or more adjacent coil loops, the three or more coil loops enclosing respective open interior portions, and intersection regions between adjacent coil loops in which seaming material forming a coil loop intersects with material forming an adjacent coil loop. The seaming material can be: a. molded to form the three or more adjacent coil loops, b. extruded in a substantially linear form and mechanically deformed into the three or more adjacent coil loops, or c. extruded such that extruded material forms the three or more adjacent coil loops either by moving an extruding head or by moving a receptacle upon which the material is extruded.

The material used to form infinity coils may be any of the materials known in the art as suitable for seams in industrial fabrics, for example a polyester monofilament, and may have any suitable cross section. Circular cross sectional shapes of the material may be used. Additionally, in non-limiting examples, other cross section shapes may be used, such as oval, rectangular, triangular, flattened, star-shaped, or other non-circular shape. Other cross sectional shapes may be used depending upon particular requirements.

FIG. 5A illustrates an infinity coil 8 according to embodiments of the invention. The coil 8 comprises first and second loops 10*a* and 10*b*. As shown, a plurality of loops 10*a*, 10*b* can extend along coil axis X-X in the direction of coil length L. Coil 8 may have any combination of number of loops 10*a*, 10*b*, and coil length L as determined by the particular application.

Width W of the coil is taken perpendicular to, or generally perpendicular to, the axis X-X and is the maximum dimension between the outermost portion of loop 10*a* and the outermost portion of adjacent loop 10*b*. The width W may be the same, or substantially the same, for all adjacent loop pairs 10*a*, 10*b*.

Within each of the coil loops 10*a* and 10*b* are open interior portions 2*a* and 2*b*, respectively. The open interior portions 2*a* and 2*b* have axes Xa and Xb, which are parallel, or generally parallel, to coil axis X. In embodiments of the inventive coils, the axis of all, or substantially all, first open interior portions 2*a* of first loops 10*a* are collinear. Similarly, in embodiments of the invention, the axis of all, or substantially all, second open interior portions 2*b* of second loops 10*b* are collinear. In some embodiments, axes X, Xa and Xb may be coplanar.

Figure 5B:
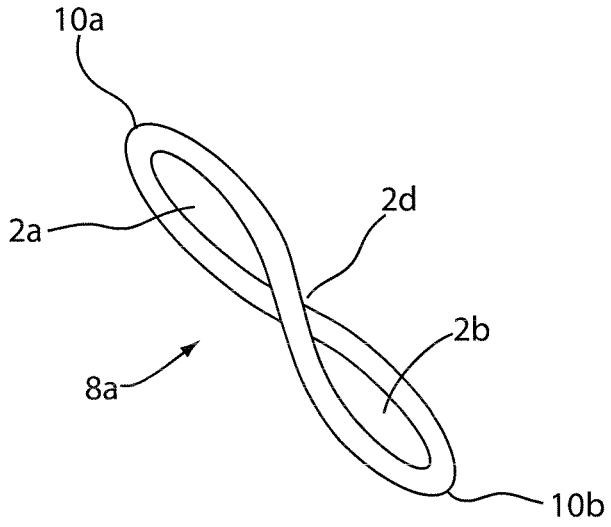
FIG. 5B is a perspective view of a separate infinity seam loop according to an embodiment of the invention.
Figure 5C:
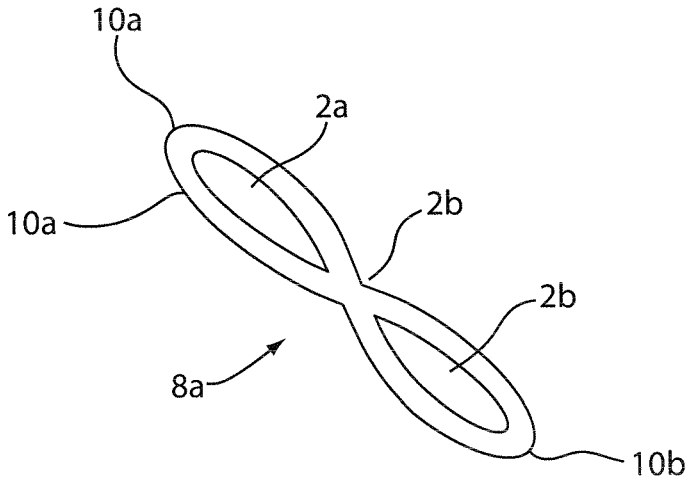
FIG. 5C is a perspective view of a separate infinity seam loop according to another embodiment of the invention.

In addition to the plurality of loops 10*a* and 10*b* shown in FIG. 5A, embodiments of the invention include individual infinity coil elements 8*a* comprising at least one complete loop 10*a* and one complete loop 10*b* as illustrated in FIG. 5B. Individual coil elements 8*a* may be formed by cutting the coil element of FIG. 5 in an appropriate location to form two complete loops and joining the free end portions 2*c* to form the individual coil element. Portions of the seam material 2*d* which cross, with one portion of the coil crossing over the other, or intersect, between the open interior portions 2*a* and 2*b* may be affixed to each other by adhesive, welding, bonding, or other known methods after formation of the coil 8*a*. Thus, one loop 10*a* and one loop 10*b* are formed, each loop forming a completely closed interior portion 2*a* or 2*b*, respectively, of individual coil element 8*a*. Alternately, other techniques may be employed in forming individual coil elements 8*a*, as shown, in FIGS. 5B and 5C. Individual coils can be formed from molten or softened polymers or resins by known plastic fabrication methods. Such methods include, as non-limiting examples, injection molding, extrusion molding, compression molding, transfer molding, or casting. In some embodiments, the portion of seam material 2*d* may intersect on the same, or substantially the same, plane between the open interior portions 2*a*, 2*b* of the coil 8*a* as illustrated in FIG. 5C. Thus the portion of seam material between the open interior portions 2*a*, 2*b* may be integrally formed with loops 10*a* and 10*b*. The individual coil elements 8*a* thus formed are comprised of one loop 10*a* and one loop 10*b*, joined at 2*d*, each loop forming a completely closed interior portion 2*a* or 2*b*, respectively.

As used herein, the term "infinity coil" includes both continuous helical infinity coils and individual infinity coil elements unless a distinction is made for clarity.

Figure 6:
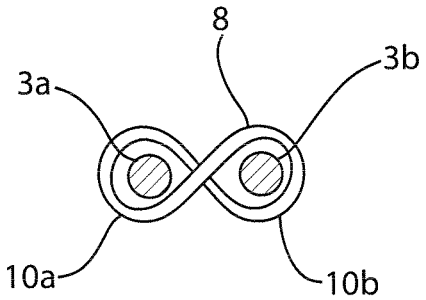
FIG. 6 is an axial view of the infinity coil of FIG. 5 formed on a double mandrel.

Continuous helical infinity coils 8 can be formed on a double mandrel coil former comprising generally parallel coplanar mandrels 3*a* and 3*b* as shown in FIG. 6. Infinity coils 8 can be formed, for example, by passing material, for example, polyester monofilament, over the top of a first mandrel 3*a*, through the space between the two mandrels, below and then around and over the top of the second mandrel 3*b*, back through the space between the mandrels and under the first mandrel 3*a*. Thus the coil forming material traces the path of a figure-eight as the infinity coils 8 are formed around mandrels 3*a* and 3*b*. This pattern can continue with each coil turn offset axially from the previous, until the desired number of coils, or the desired axial length of the infinity coil 8, which may be proportional to the number of coils, is formed. In this manner a seaming element comprising a plurality of infinity coils 8 can be formed with loops 10*a* and 10*b*, with each loop 10*a* formed coaxially with previous loops 10*a* and each loop 10*b* formed coaxially with previous loops 10*b*.

The two individual mandrels 3*a* and 3*b* comprising the double mandrel are illustrated as having a round cross section for ease of illustration only. The mandrels may be of any suitable shape to yield the desired shape of the infinity coil loops 10*a* and 10*b*. The mandrels are also shown as substantially the same size for ease of illustration. However, the mandrels 10*a* and 10*b* may be the same, or substantially the same size, or one mandrel may be larger than the other, or differently shaped, as desired.

Other techniques may be employed in forming the inventive infinity coils. For example, the infinity coil could be molded from a molten or softened polymer or resin as one piece using known molding methods, such as, for example, injection molding, extrusion molding, compression molding, transfer molding, or casting. The material used for the coil could also be extruded in a linear or near linear form and mechanically deformed into the lemniscate or infinity shape, with or without the application of heat. The material could also be extruded in a manner such that the extruded material forms the lemniscate or infinity shape either by moving the extruding head or by moving the bed or receptacle upon which the material is extruded.

Figure 7:
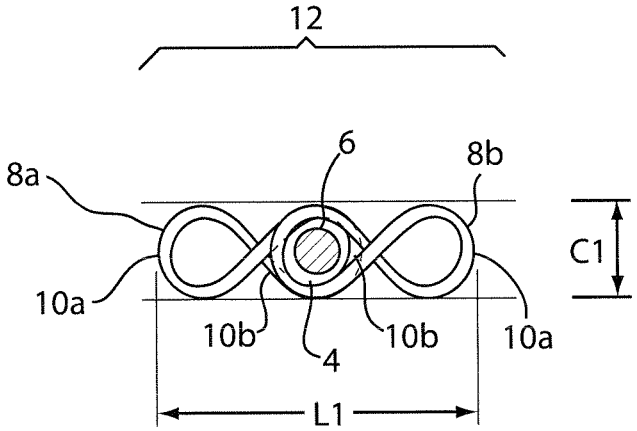
FIG. 7 is an axial view of an infinity coil seam according to embodiments of the invention.

In forming an infinity coil seam 12 as illustrated in FIG. 7, a first infinity coil 8*a* is joined with a first fabric edge (not shown) and a second infinity coil 8*b* is joined with a second fabric edge (not shown) via respective loops 10*a* of the infinity coils 8*a* and 8*b*. In the non-limiting embodiment illustrated in FIG. 7, infinity coils 8*a* and 8*b* each include loops 10*a* to be joined to first and second fabric edges (not shown) using a known method of joining, such as a pintle. Loops 10*b* from first infinity coil 8*a* are interdigitated with loops 10*b* from second infinity coil 8*b* such that the open interior portions 2*b* of the loops 10*b* at least partially align and form a single passage 4 in the seam 12. The passage 4 may be sized to allow a pintle or pin 6 to pass through the aligned open interior portions 2*b* of loops 10*b*, joining the coil seam elements 8*a* and 8*b*. The loops 10*b* from the first and second infinity coil loops 8*a* and 8*b* may interdigitated and alternate, i.e., alternatingly interdigitate, one loop from a first coil, the next loop from a second coil, followed by a loop from the first coil in a repeated pattern along the length of the seam. However, other patterns of interdigitation may be used as required.

In an embodiment, infinity coil seam 12 is formed from one or more first infinity continuous helical coils 8*a* disposed axially end-to-end and one or more second continuous helical infinity coils 8*b* disposed axially end-to-end in the CD direction of respective fabric edges. In another embodiment, infinity coil seam 12 is formed from a plurality of first individual infinity coil elements disposed side-by-side so the open interior portions thereof substantially align with one another and a plurality of second individual infinity coil elements disposed side-by-side so the open interior portions thereof substantially align with one another in the CD direction of respective fabric edges.

Figure 8:
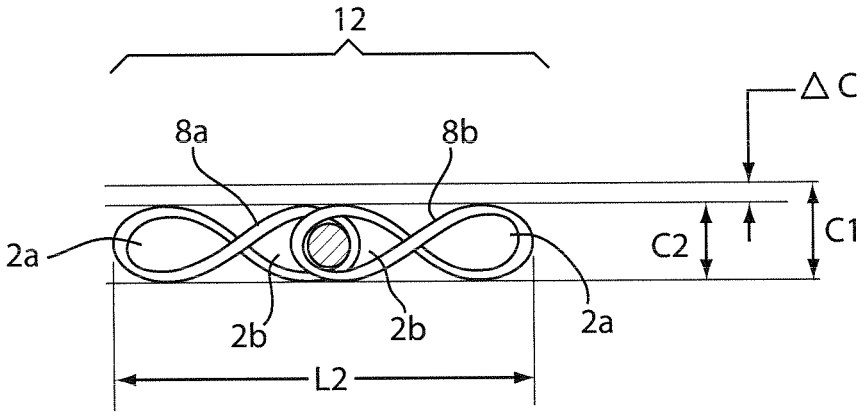
FIG. 8 is an axial view of the seam of FIG. 7 under an increased tensile load transverse to the axis of the seam.

One benefit of the disclosed infinity coil seam 12 is the additional seam thinning realized when the seam and the fabric are placed in tension generally perpendicular to the seam axis, in the length direction of the industrial fabric, as compared to a prior art seam. As illustrated in FIG. 7, the thickness of the infinity coil loops 10*a* and 10*b* is not greater than the thickness C1 of the fabric. As illustrated in FIG. 8, the seam 12 is under tension, and the thickness C2 of the infinity coil loops 10*a* and 10*b* is desirably less than the thickness C1 of the fabric. The seam thinning as illustrated is a desirable characteristic as it places the infinity coil 8 at or below the plane of the industrial fabric. The distance ΔC as shown in FIG. 8 is the total amount of seam thinning the coil experiences. In practice, the amount of seam thinning would be approximately evenly distributed throughout the thickness, i.e. the top and bottom surfaces, of the infinity coil.

Figure 9:
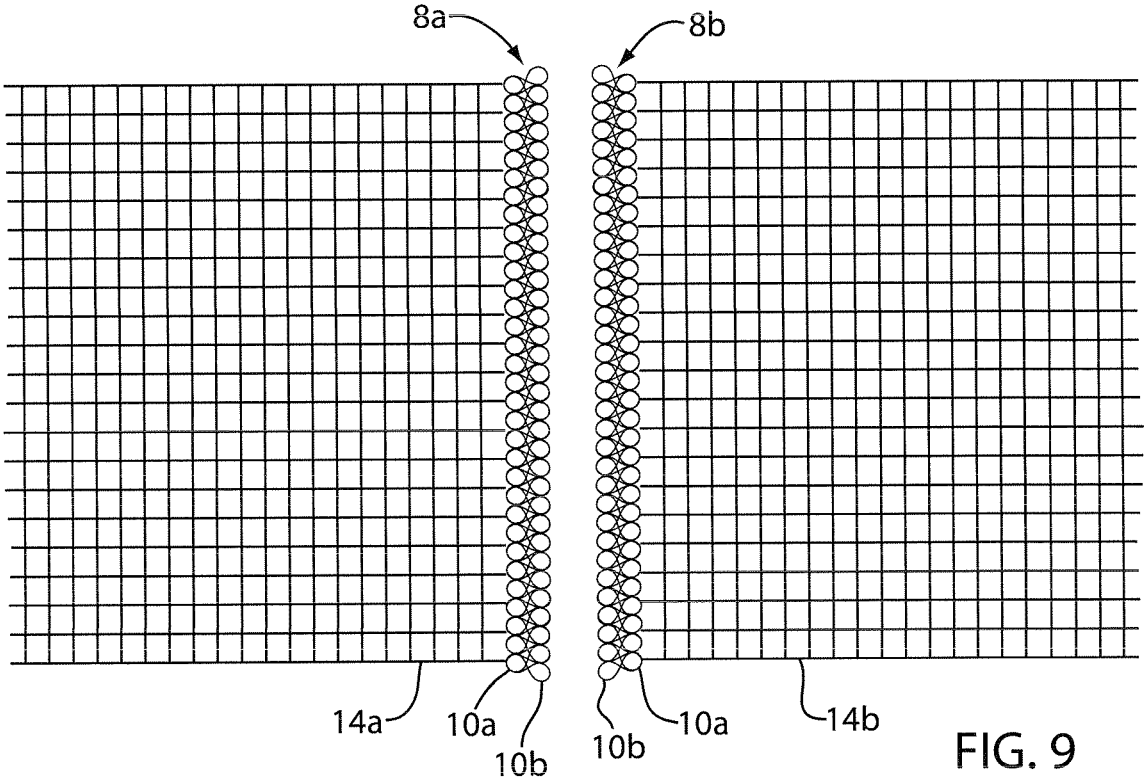
FIG. 9 is a plan view of infinity coils according to embodiments of the invention joined to fabric edges.

According to embodiments of the present invention, an industrial fabric may be formed from a fabric with the disclosed infinity coils used to form a seam between opposite edges of the fabric. As illustrated in FIG. 9, infinity coils 8*a* and 8*b* may be joined to opposite fabric edge portions 14*a* and 14*b* in preparation for joining the edge portions together. As illustrated in FIG. 9, infinity seam loops 10*a* of infinity coils 8*a* and 8*b* are joined to the fabric edge portions 14*a* and 14*b*. Joining of the infinity loops to the fabric may be accomplished in any way known to the art, for example, a pintle or pin may be used to join the infinity loops 10*a* to loops formed at the fabric edges, or fabric yarns may be woven through the infinity coil loops 10*a* and reintroducing the yarns to the fabric, or the infinity loops may be joined to the fabric by sewing, or by other known techniques.

Figure 10:
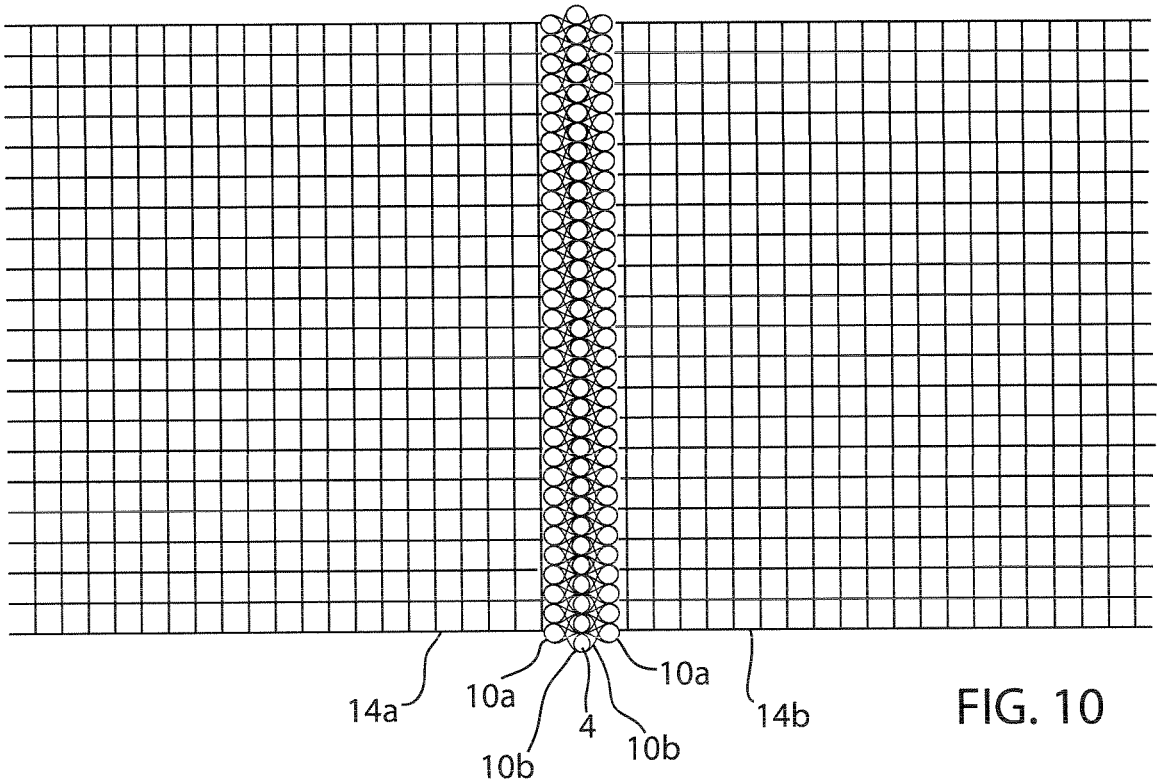
FIG. 10 is a plan view of the infinity coils of FIG. 9 with coils interdigitated.

Having attached the infinity coils 8*a* and 8*b* to the fabric edge portions 14*a* and 14*b*, respectively, the fabric edges may be drawn toward each other such that infinity loops 10*b* of infinity coil 8*a* may interdigitate with loops 10*b* of infinity coil 8*b* and open interior space 2*b* of infinity loops 10*b* at least partially align with each other to form a single passage (reference 4 in FIG. 7) as illustrated in FIG. 10.

Figure 12:
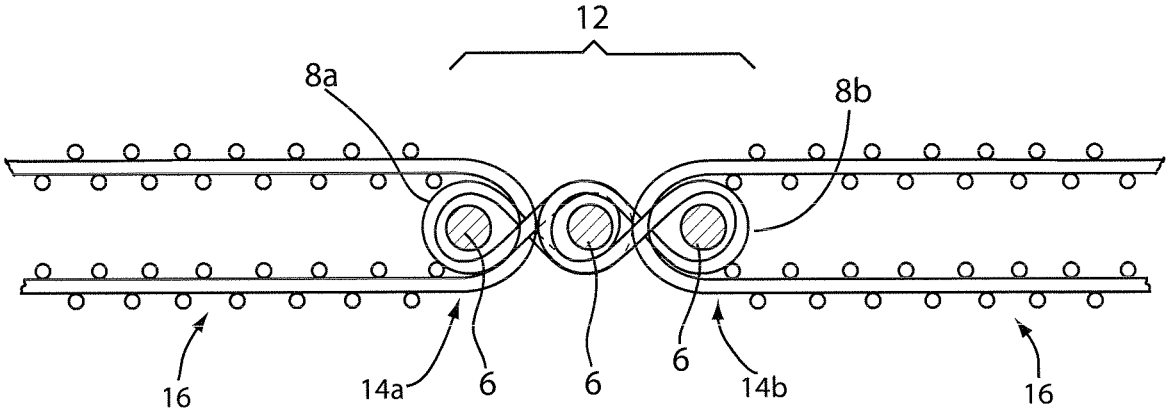
FIG. 12 is an axial view of an infinity coil seam joining fabric edges in accordance with an embodiment of the invention.

A pintle or pin 6 may be passed through the formed passage and through all, or substantially all, of the infinity coil loops 10*b* joining infinity coil 8*a* with infinity coil 8*b*. In instances in which infinity coils 8*a* and 8*b* are joined to opposite edges of the same fabric article, an industrial fabric 16 is formed as a continuous loop. As shown in FIG. 12, a pintle or pin or wire 6 may be used to join each infinity coil to the fabric edge portions 14*a* and 14*b*, although any known joining technology could be used.

As discussed above, the joining of a first infinity loop 8 to a fabric edge or to a second infinity loop 8, with a pintle or otherwise, creates a joint adapted to pivot to a degree about an axis of the infinity coil loops thus joined. In joints with a pintle 6 or the like, the longitudinal axis of the pintle substantially aligns with the axis of the infinity coil loop 10*b* and at least approximates the pivot axis of the joint and the seam as shown in FIG. 7.

The seam 12 in industrial fabric 16 as shown in FIG. 12 behaves in a manner similar to the seam 12 in FIGS. 7 and 8. That is, when the industrial fabric 16 is under tension perpendicular to, or substantially perpendicular to, the seam 12 in the length direction of the industrial fabric, that is, a longitudinal tension, the seam 12 will also be under tension and experience seam thinning. The infinity seam coils 8*a* and 8*b* will decrease in thickness measured perpendicular to the longitudinal tension. The ΔC of FIG. 8 will be positive and the infinity coil loops will move away from the plane of the fabric, towards the interior of the fabric, resulting in a seam as thin, or thinner than, the fabric edges 14*a* and 14*b*. Concurrently, the length of the seam, L1 in FIG. 7 will increase to L2 of FIG. 8.

Figure 11:
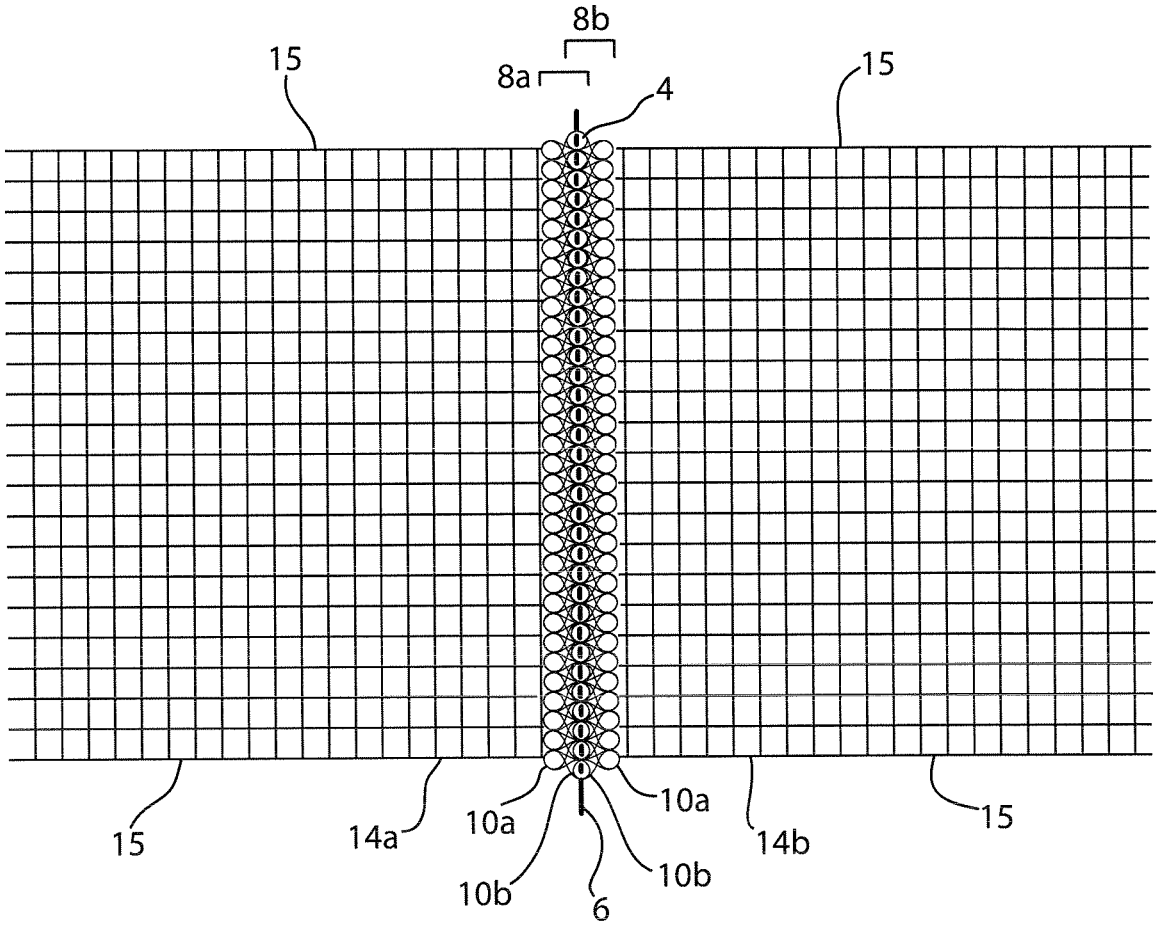
FIG. 11 is a plan view of the infinity coils of FIG. 10 with a pintle inserted to join fabric edges.

In some embodiments, the seam 12 may be perpendicular to fabric longitudinal edges 15 as illustrated in FIG. 11. In other embodiments, the seam may form an angle other than 90° with the fabric longitudinal edges. Regardless of the seam orientation, the seam 12 will behave in a manner substantially similar to the embodiment in which the seam is perpendicular to the longitudinal edges. The tension in the industrial fabric 16 in the length direction of the industrial fabric and the size of the pintles will result in seam thinning to a greater or lesser extent.

An advantage of the present technique is that during installation on an industrial machine, insertion of the pintle can be easier as the interior opening is larger before tension is applied than after tension is applied.

Having thus described in detail various embodiments of the present invention, it is to be understood that the invention defined by the above paragraphs is not to be limited to particular details set forth in the above description as many apparent variations thereof are possible without departing from the spirit or scope of the present invention.

What is claimed is:

1. A low profile seam for joining fabric edges, said seam comprising:

a first element comprising one or more first infinity coils wherein each of the one or more first infinity coils consists essentially of a first loop having a first open interior portion, a second loop having a second open interior portion, and an intersection region where the first loop intersects with the second loop, and wherein the first loops of the first infinity coils are joined to seam loops of a first fabric edge;

a second element comprising one or more second infinity coils wherein each of the one or more second infinity coils consists essentially of a first loop having a first open interior portion and a second loop having a second open interior portion, and an intersection region wherein the first loop intersects with the second loop, and wherein the first loops of the second infinity coils are joined to seam loops of a second fabric edge;

wherein a machine direction length of each of the first and second infinity coils is less than a machine direction length of the fabric;

wherein second loops of the first infinity coils, and second loops of the second infinity coils are interdigitated such that the second open interior portions of the second loops of the first infinity coils at least partially align with the second open interior portions of the second loops of the second infinity coils to form a passage therethrough;

a pintle disposed in the passage formed by the aligned second open interior portions of the first loops and the second open interior portions of the second loops to join a first fabric edge to the second fabric edge; and wherein the infinity coils are formed from material selected from the group consisting of a monofilament, twisted multifilaments, and metal wire.

2. The seam of claim 1, wherein a tensile load across the seam reduces a caliper or thickness of the infinity coil elements.

3. The seam of claim 1, wherein the first fabric edge and the second fabric edge are opposite edges of the same fabric.

4. The seam of claim 1, wherein the second loops of the first infinity coils alternatingly interdigitate with the second loops of the second infinity coils.

5. The seam of claim 1, wherein the monofilament, twisted multifilaments, or metal wire making the infinity coils is round, rectangular, oval, or flattened in cross section.

6. The seam of claim 5, wherein the infinity coils are coated.

7. The seam of claim 1, wherein the one or more first infinity coils and the one or more second infinity coils are continuous helical infinity coils.

8. The seam of claim 7, wherein the one or more first infinity coils are two or more first infinity coils arranged end to end along the cross-machine direction of the first fabric edge and the one or more second infinity coils are two or more second infinity coils arranged end to end along the cross-machine direction of the second fabric edge.

9. The seam of claim 7, wherein the one or more first infinity coils is a single continuous helical infinity coil.

10. The seam of claim 1, wherein the one or more first infinity coils and the one or more second infinity coils are individual infinity coils arranged adjacent to one another along the cross-machine direction of the first and second fabric edges, respectively.

11. An infinity coil for joining fabric edges, the coil comprising:

a plurality of infinity coil elements comprising a plurality of loops, wherein each of the plurality of infinity coil elements consist essentially of a first loop, a second loop, and an intersection region where the first loop intersects with the second loop, in a shape of a lemniscate, wherein the axes of each of the first loops are collinear with each other along a first axis, the axes of each of the second loops are collinear with each other along a second axis, and the first and second axes are parallel with each other;

the plurality of infinity coil elements being joined to an edge of a fabric;

wherein a machine direction length of each of the infinity coil elements is less than a machine direction length of the fabric;

wherein, when viewed parallel to the first and second axes, each of the plurality of loops forms a closed curve with a respective open interior portion; and wherein the infinity coil elements are formed from material selected from the group consisting of a monofilament, twisted multifilaments, and metal wire.

12. The coil of claim 11, wherein the plurality of loops forms at least two closed curves.

13. An infinity coil for joining two fabric edges, the coil comprising:

a coil axis;

an axial length parallel to the coil axis;

a width perpendicular to the axial length;

a continuous strand of material formed into a continuous helical plurality of infinity coil elements, wherein each of the plurality of infinity coil elements is in a shape of lemniscate having a first loop, a second loop, and an intersection region where the first loop intersects with the second loop, each of the loops having an axis parallel to the axis of the coil;

the plurality of infinity coil elements being joined to at least one edge of a fabric;

wherein a machine direction length of each of the infinity coil elements is less than a machine direction length of the fabric;

wherein, the axes of the first loops are collinear with one another and the axes of the second loops are collinear with one another such that, when viewed parallel to the coil's axis, each of the loops appears to form a closed curve with an open interior portion; and wherein the infinity coil elements are formed from material selected from the group consisting of a monofilament, twisted multifilaments, and metal wire.

14. The coil of claim 13, wherein the plurality of infinity coil elements is continuous along the length of the coil axis.

15. The coil of claim 13, wherein the coil is coated.

16. A seam element for a low profile seam comprising:

a seaming material formed as a series of lemniscates joined to at least one edge of a fabric, each lemniscate having two closed curves forming a first coil loop, a second coil loop, and an intersection region between the closed curves where the first coil loop intersects with the second coil loop, the first and second coil loops enclosing respective first and second open interior portions, wherein the series of lemniscates is aligned in that each of the first coil loops has an axis parallel to the axis of each of the second coil loops;

wherein a machine direction length of each of the lemniscates is less than a machine direction length of the fabric; and wherein the seaming material is from material selected from the group consisting of a monofilament, twisted multifilaments, and metal wire.

17. The seam element of claim 16, wherein the seam element is coated.

18. The seam element of claim 16, wherein lemniscates of the series of leminscates are planar.

19. A seam comprising:

a first plurality of the seam elements of claim 16, arranged adjacent to each other on a first fabric edge by joining the first coil loops to seam loops of the first fabric edge such that the first open interior portions of the first coil loops are substantially collinear with an adjacent seam element;

a second plurality of the seam elements of claim 16, arranged adjacent to each other on a second fabric edge by joining the first coil loops to seam loops of the second fabric edge such that the first open interior portions of the second coil loops are substantially collinear with an adjacent seam element, wherein the first plurality of seam elements and the second plurality of seam elements are interdigitated such that the second open interior portion of each of the second coil loops of the first plurality of seam elements is aligned with the second open interior portion of each of the second coil loops of the second plurality of seam elements to form a passage therethrough; and a pintle extending through the passage.

20. A seam element comprising:

a seaming material formed as three or more closed curves forming three or more adjacent coil loops, each of the three or more coil loops enclosing one open interior portion, and intersection regions between adjacent coil loops in which a coil loop intersects with an adjacent coil loop, wherein a plurality of the seam elements are joined to fabric edges and to each other to form a low profile seam;

wherein a machine direction length of the seam elements is less than a machine direction length of the fabric; and wherein the seaming material is formed from material selected from the group consisting of a monofilament, twisted multifilaments, and metal wire.

21. The seam element of claim 20, wherein the seam element is coated.

22. The seam element of claim 20, wherein the adjacent coil loops are planar.

23. A seam comprising:

a first plurality of seam elements of claim 20, arranged adjacent to each other on a first fabric edge by joining one of the three or more coil loops to seam loops of the first fabric edge such that each of the interior portions of the coil loops are substantially collinear with an adjacent seam element;

a second plurality of seam elements of claim 20, arranged adjacent to each other on a second fabric edge by joining one of the three or more coil loops to seam loops of the second fabric edge such that each of the interior portions of the coil loops are substantially collinear with an adjacent seam element;

wherein the first plurality of seam elements and the second plurality of seam elements are interdigitated such that at least one open interior portion of each of the second plurality of seam elements is aligned with an open interior portion of the first plurality of seam elements to form at least one passage; and a pintle extending through the at least one passage.

* * * * *